US010378801B2

(12) United States Patent
Iio

(10) Patent No.: US 10,378,801 B2
(45) Date of Patent: Aug. 13, 2019

(54) REFRIGERANT TANK

(71) Applicant: DENSO CORPORATION, Kariya, Aichi-pref. (JP)

(72) Inventor: Masanobu Iio, Kariya (JP)

(73) Assignee: DENSO CORPORATION, Kariya (JP)

( * ) Notice: Subject to any disclaimer, the term of this patent is extended or adjusted under 35 U.S.C. 154(b) by 126 days.

(21) Appl. No.: 15/649,744

(22) Filed: Jul. 14, 2017

(65) Prior Publication Data

US 2018/0180336 A1 Jun. 28, 2018

(30) Foreign Application Priority Data

Dec. 22, 2016 (JP) ..... 2016-248630

(51) Int. Cl.

| | |
|---|---|
| ***F25B 39/04*** | (2006.01) |
| ***F25B 43/00*** | (2006.01) |
| *F28F 9/02* | (2006.01) |
| *F28F 9/26* | (2006.01) |
| *F28D 1/053* | (2006.01) |
| *F28D 21/00* | (2006.01) |

(52) U.S. Cl.

CPC ..... *F25B 39/04* (2013.01); *F25B 43/003* (2013.01); *F25B 2339/0441* (2013.01); *F25B 2400/16* (2013.01); *F28D 1/05375* (2013.01); *F28D 2021/0084* (2013.01); *F28F 9/0212* (2013.01); *F28F 9/262* (2013.01)

(58) Field of Classification Search

CPC ..... F25B 39/04; F25B 43/003; F25B 43/006; F25B 2339/0441; F25B 2400/16; F28F 9/0212; F28F 9/262; F28D 2021/0084; F28D 1/05375; B60H 1/3229

See application file for complete search history.

(56) References Cited

U.S. PATENT DOCUMENTS

2009/0288443 A1 11/2009 Lautner et al.

FOREIGN PATENT DOCUMENTS

JP 3629819 B2 * 3/2005 ..... F25B 2339/0441
JP 3629819 B2 3/2005

* cited by examiner

*Primary Examiner* — Emmanuel E Duke

(57) ABSTRACT

The present disclosure provides a refrigerant tank for storing a refrigerant circulating in a cooling circuit. The refrigerant tank includes a housing body and a desiccant bag. The housing body defines therein a space for storing the refrigerant. The desiccant bag houses a desiccant therein and is disposed inside the space of the housing body. The housing body includes a side surface defining an opening through which the refrigerant passes. The refrigerant tank further includes a contact preventing member that prevents the desiccant back from coming into contact with an edge of the opening.

10 Claims, 7 Drawing Sheets

COMPARATIVE EXAMPLE

REFRIGERANT TANK

CROSS REFERENCE TO RELATED APPLICATION

This application is based on reference Japanese Patent Application No. 2016-248630 filed on Dec. 22, 2016, the disclosure of which is incorporated herein by reference.

TECHNICAL FIELD

The present disclosure relates to a refrigerant tank to store a refrigerant circulating in a cooling circuit.

BACKGROUND

A cooling circuit used in, e.g., a vehicle air-conditioning unit is configured to circulate a refrigerant in passages that extend through an evaporator, a condenser, or the like. Typically, a refrigerant tank is disposed in a middle position of the passages in which refrigerant circulates. The refrigerant tank is configured to store the refrigerant to separate vapor refrigerant from liquid refrigerant. As a refrigerant tank, there have been a modulator tank, which is integrally formed with a condenser, or a receiver tank, which is disposed downstream of the condenser, for example.

Refrigerant may contain water during circulation of the cooling circuit. If such a refrigerant containing water circulates in the cooling circuit, the water may be condensed at an expansion valve, which will lead to occurrence of clogging in the expansion valve. Therefore, it is necessary to remove water from refrigerant circulating in the cooling circuit during cooling cycle operation.

Japanese Patent JP3629819B discloses the condenser integrally having a liquid receiver tank. The condenser has a desiccant in the liquid receiver tank (one type of refrigerant tanks) to adsorb water contained in the refrigerant. The desiccant, which is housed in a bag (hereinafter, referred to as a "desiccant bag"), is disposed in a lower side of the refrigerant tank.

An opening is formed in a side surface of the refrigerant tank to allow the refrigerant to pass therethrough. Such an opening is formed as an inlet to allow the refrigerant to flow into the refrigerant tank or as an outlet to allow the refrigerant to flow out of the refrigerant tank.

More specifically, the condenser described in the Japanese Patent includes the opening as an inlet for the refrigerant that is formed in a side surface of the refrigerant tank facing the desiccant bag. During circulation of the refrigerant in the cooling circuit, a force in a direction away from the wall surface of the refrigerant tank is applied to the desiccant bag due to a pressure by the refrigerant flowing into the refrigerant tank through the opening.

On the other hand, when the circulation of the refrigerant in the cooling circuit is stopped, a revers flow of the refrigerant from the refrigerant tank to an outside may temporarily generate due to a temperature difference in the refrigerant in the cooling circuit. In this case, a force in a direction toward the wall surface of the refrigerant tank is applied to the desiccant bag due to the refrigerant flowing out through the opening. As a result, the desiccant bag is pressed against an edge of the opening by the force.

When the circulation of the refrigerant in the cooling circuit repeatedly starts and stops, the desiccant bag is repeatedly brought into contact with the edge of the opening.

Therefore, shearing forces are also applied to the desiccant bag, and as a result, the desiccant bag may be damaged due to the shearing forces.

In view of the above, it is an objective of the present disclosure to provide a refrigerant tank where a desiccant bag is prevented from being damaged.

SUMMARY

An aspect of the present disclosure provides a refrigerant tank for storing a refrigerant circulating in a cooling circuit. The refrigerant tank includes a housing body and a desiccant bag. The housing body defines therein a space for storing the refrigerant. The desiccant bag houses a desiccant therein and is disposed inside the space of the housing body. The housing body includes a side surface defining an opening through which the refrigerant passes. The refrigerant tank further includes a contact preventing member that prevents the desiccant back from coming into contact with an edge of the opening.

According to the refrigerant tank, the contact preventing member prevents the desiccant bag from coming into contact with an edge of the opening. The contact preventing member may be a member that protects the desiccant bag by covering a portion of the desiccant bag. Accordingly, the desiccant bag is prevented from directly receiving a shearing force due to a flow of the refrigerant, and therefore it is possible to suppress a damage to the desiccant bag.

As described above, the present disclosure provides the refrigerant tank that prevents the desiccant bag from being damaged.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

It is needless to say that following embodiments are some examples of the present disclosure, and therefore the present disclosure is not limited to these embodiment. Furthermore, each of the substantially same structures among the embodiments will be assigned to the respective common referential numeral and the description of the substantially same structures will be omitted in the subsequent embodiments.

The first embodiment will be described below. A refrigerant tank 100 according to the present embodiment is integrally formed with a condenser 10 used for a vehicular air-conditioning unit (not shown). The condenser 10 serves as one component forming a cooling circuit of the vehicular air-conditioning unit. The configuration of the condenser 10 will be described first.

Figure 1:
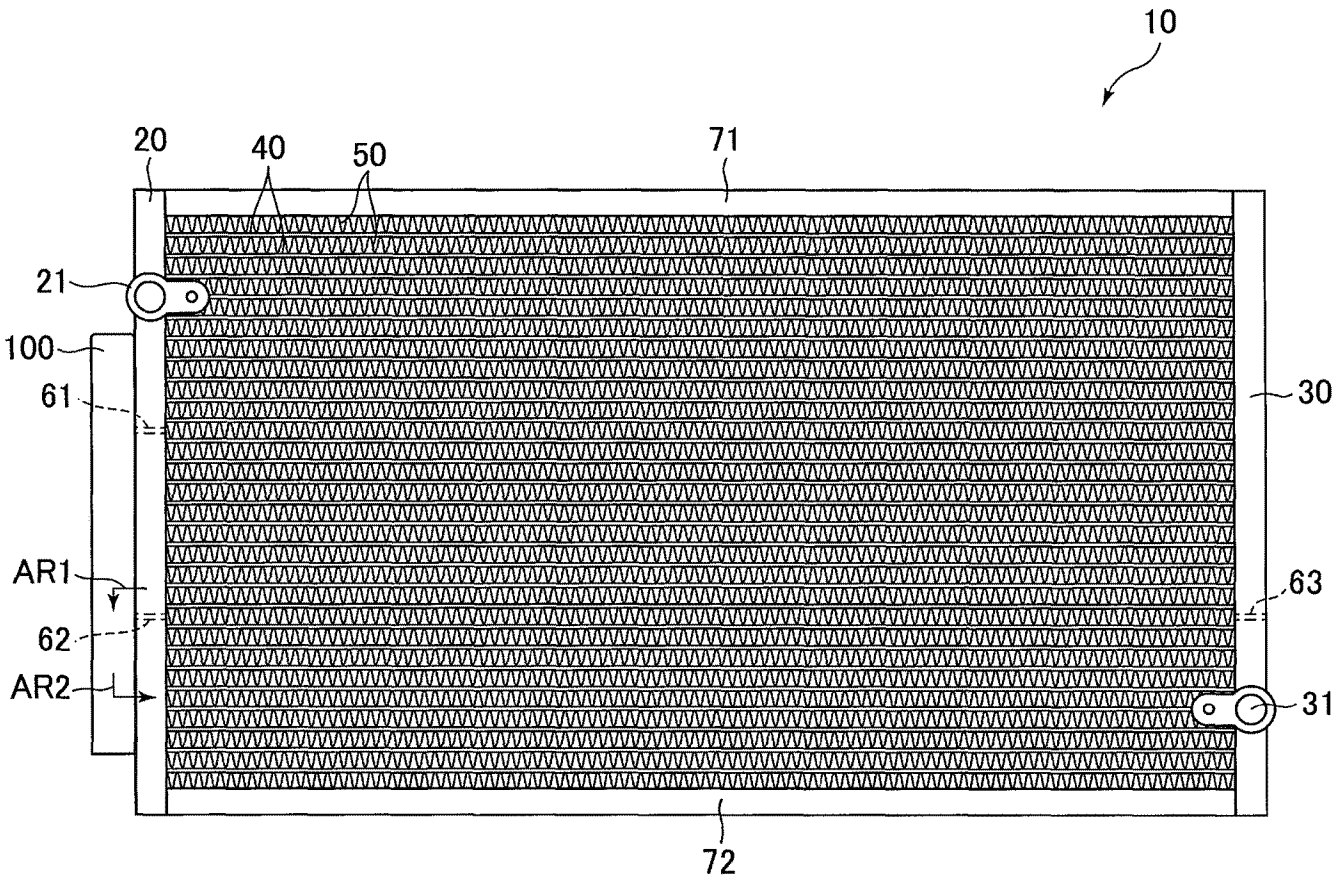
FIG. 1 is a diagram illustrating a refrigerant tank and a condenser integrally formed with the refrigerant tank according to a first embodiment.

The condenser 10 is a heat exchanger that condenses refrigerant therein by exchanging heat between the refrigerant circulating in the cooling circuit and air passing through the condenser 10. As shown in FIG. 1, the condenser 10 includes a tank 20, a tank 30, tubes 40, and fins 50.

The tank 20 temporarily stores refrigerant supplied thereto. The tank 20 is formed as an elongated container having substantially a columnar shape. The tank 20 is arranged such that the longitudinal direction thereof extends along the vertical direction of the condenser 10.

A receiving portion 21 is formed in the tank 20 at an upper side portion of the tank 20 relative to a center position in the vertical direction. The receiving portion 21 receives refrigerant from an outside of the tank 20 and allows the refrigerant to flow into the tank 20. The receiving portion 21 serves as a connector connected to a pipe for the refrigerant forming the cooling circuit.

The tank 30 serves as a container to temporarily store refrigerant as with the tank 20. The tank 30 is formed as an elongated container having substantially a columnar shape. The tank 30 is arranged such that the longitudinal direction thereof extends in parallel with the longitudinal direction of the tank 20.

A discharging portion 31 is formed in the tank 30 at a lower side portion of the tank 30 relative to a center position in the vertical direction. The discharging portion 31 is to discharge the refrigerant that was introduced into the tank 30 through the tubes 40. The discharging portion 31 serves as a connector connected to a pipe for the refrigerant forming the cooling circuit as with the receiving portion 21 of the tank 20.

The tubes 40 are metal pipes each having a cylindrical shape. A plurality of tubes 40 are disposed in the condenser 10. A passage for the refrigerant is defined in each of the tubes 40. The tube 40 has a cross-section, which is taken along a direction perpendicular to the flow direction of the refrigerant in the tube 40, having an elliptical shape with the major axis extending along a flow direction of the air (i.e., the direction perpendicular to FIG. 1).

Each of the tubes 40 has one end connected to the tank 20 and the other end connected to the tank 30. Therefore, the inside space of the tank 20 is in fluid communication with the inside space of the tank 30 through the tubes 40.

The tube 40 has a longitudinal direction perpendicular to the longitudinal direction of the tank 20 (the tank 30). The tubes 40 are stacked with each other along the longitudinal direction of the tank 20 (i.e., the vertical direction).

The fins 50 are metal plates curved into wave forms. That is, each of the fins 50 has a plurality of upper apexes and a plurality of lower apexes alternately arranged along a lateral direction perpendicular to the vertical direction. Each of the fins 50 is inserted into a space between the neighboring tubes 40. Each of the upper apexes and each of the lower apexes of the fin 50 are brazed with a lower surface of the tube 40 and an upper surface of the tube 40, respectively. During the cooling cycle operation, heat of the refrigerant is transferred to the air through the tubes 40 as well as through the tubes 40 and the fins 50. That is, the total contact area with the air is enlarged by the fins 50, and therefore heat transfer between the air and the refrigerant is efficiently performed.

The tubes 40 and the fins 50 form a so-called "heat exchanger core" in which heat transfer between the air and the refrigerant is performed. Two side plates 71, 72 made of metal are disposed at an upper side and a lower side of the heat exchanger core. The side plates 71, 72 support the heat exchanger core to maintain the shape by clamping the heat exchanger core from the upper and lower sides.

A separator 61 having a plate shape is disposed inside the tank 20 at an upper side of the tank 20 relative to the center position of the tank 20 in the vertical direction. The separator 61 divides the inside space of the tank 20 into an upper space and a lower space. The position of the separator 61 is lower than the position of the receiving portion 21.

A separator 62 having a plate shape is further disposed inside the tank 20 at a lower side of the tank 20 relative to the center position of the tank 20 in the vertical direction (i.e., disposed in the lower space of the tank 20). The separator 62 further divides the lower space of the tank 20 into two spaces. That is, the inside space of the tank 20 is divided into the three spaces.

Similarly, a separator 63 having a plate shape is disposed inside the tank 30 at a lower side of the tank 30 relative to the center position of the tank 30 in the vertical direction. The separator 63 divides the inside space of the tank 30 into an upper space and a lower space. The position of the separator 63 is substantially the same as the position of the separator 62 in the tank 20. Further, the position of the separator 63 is higher than the position of the discharging portion 31.

Next, the flow of the refrigerant during cooling cycle operation will be described. The refrigerant is compressed by a compressor (not shown) at an upstream side of the condenser 10 in the cooling circuit, and then supplied to the condenser 10 at a high temperature and a high pressure. At this point, the substantially entire of refrigerant is in a vapored state. The refrigerant flows into the tank 20 through the receiving portion 21 and is temporarily stored in an upper space higher than the separator 61. Thereafter, the refrigerant flows into each of the tubes 40 and flows toward the tank 30 through the tubes 40.

When the refrigerant reaches the tank 30, the refrigerant is temporarily stored in an upper space of the tank 30 higher than the separator 63. The refrigerant flows into the tubes 40 that are lower than the separator 61 and higher than the separator 63. Then, the refrigerant flows through the tubes 40 toward the tank 20.

When the refrigerant reaches again the tank 20, the refrigerant is temporarily stored in a space of the tank 20 that is lower than the separator 61 and higher than the separator 62. The refrigerant flows into the refrigerant tank 100 through a passage as indicated by the arrow AR1 in FIG. 1, and then the refrigerant is temporarily stored in a space SP (see FIG. 2) defined in the refrigerant tank 100.

Thereafter, the refrigerant flows into the tank 20 through a passage indicated by the arrow AR2 in FIG. 1, and is temporarily stored in a space of the tank 20 lower than the separator 62. The refrigerant flows into the tubes 40 that are lower than the separator 62, and then flows through the tubes 40 toward the tank 30.

When the refrigerant reaches the tank 30, the refrigerant is temporarily stored in a space of the tank 30 lower than the separator 63. Then, the refrigerant is discharged through the discharging portion 31 and flows toward an expansion valve (not shown) arranged downstream of the condenser 10 in the cooling circuit.

As described above, the refrigerant goes and comes back between the tank 20 and the tank 30 through the tubes 40. During this flow, the refrigerant is cooled by the outside air passing through the heat exchange core. That is, heat radiation from the refrigerant to the air is performed. Accordingly, temperature of the refrigerant flowing through the tubes 40 decreases, and as a result, a portion or the entire of the refrigerant is condensed into liquid phase from vapored phase. Conversely, the air passing through the heat exchange core is heated and thus temperature of the air increases.

The refrigerant flowing into the refrigerant tank 100 through the passage indicted by the arrow AR1 is in a vapor-liquid mixed state due to the above described condensation. The separation of the liquid refrigerant from the vapored refrigerant is performed in the refrigerant tank 100. Therefore, the liquid refrigerant is stored in a lower space of the refrigerant tank 100. Almost of all the refrigerant flowing into the lower space of the tank 20 through the passage indicated by the arrow AR2 is the liquid refrigerant. A portion of the heat exchange core lower than the separators 62, 63 serves as a so-called "sab-cooling portion" through which the liquid refrigerant flows.

As described above, the refrigerant tank 100 according to the present embodiment is integrally formed with the condenser 10, and serves as a "modulator tank" to store the circulating refrigerant.

Figure 2:
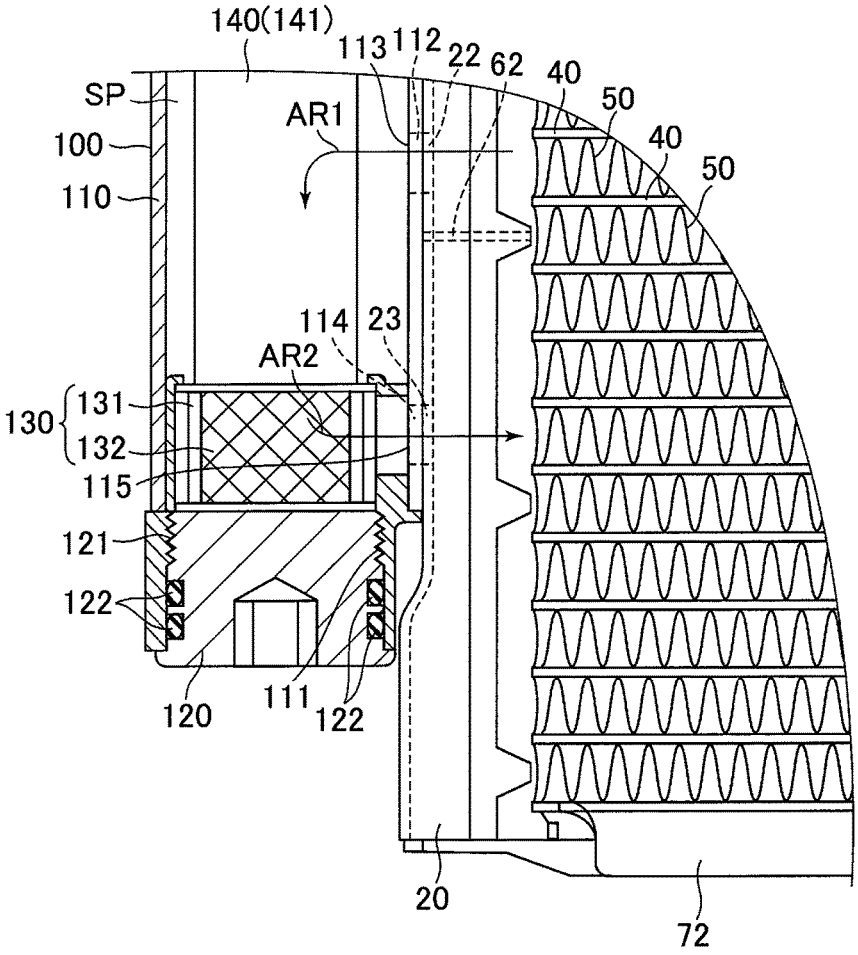
FIG. 2 is a cross-section of a portion of the refrigerant tank.

Referring to FIG. 2, the configuration of the refrigerant tank 100 will be described. FIG. 2 shows a cross-section of a lower portion of the refrigerant tank 100 illustrating an internal structure thereof. The refrigerant tank 100 includes a housing body 110, a sealing member 120, a filter 130, and a desiccant bag 140.

The housing body 110 is a cylindrical member forming a main part of the refrigerant tank 100. The housing body 100 defines a space SP therein to store the refrigerant. As with the tank 20, the housing body 110 is formed as an elongated columnar shape, and is arranged such that the longitudinal direction of the housing body 110 extends along the vertical direction. The housing body 110 is adjacent to the tank 20 and the side surface of the housing body 110 is connected to the side surface of the tank 20.

A through hole 112 is formed in the side surface of the housing body 110 facing the tank 20. The position of the through hole 112 is higher than the position of the separator 62. A through hole 22 is formed in the side surface of the tank 20 to face the through hole 112.

The housing body 110 and the tank 20 are connected to each other such that the through hole 112 is aligned with the through hole 22. Thus, the space SP and the inside space of the tank 20 are in fluid communication with each other through the through holes 22, 112. Therefore, the refrigerant stored in the tank 20 is allowed to flow into the space SP from tank 20 along the arrow AR1.

In this way, the though hole 112 serves as a hole to allow the refrigerant to flow into the space SP along the arrow AR1. Hereinafter, an opening of the through hole 112, which is open in the space SP and from which the refrigerant flows into the space SP, is referred to as an "opening 113".

A through hole 114 is further formed in the side surface of the housing body 110 facing the space 20. The position of the through hole 114 is lower than the position of the separator 62. A through hole 23 is formed in the side surface of the tank 20 to face the through hole 114.

The housing body 110 and the tank 20 are connected to each other such that the through hole 114 is aligned with the through hole 23. Thus, the space SP and the inside space of the tank 20 are in fluid communication with each other through the through holes 23, 114. Thus, the refrigerant stored in the space SP is allowed to flow out through the through holes 23, 114 toward the tank 20 along the arrow AR2.

In this way, the though hole 114 serves as a hole to allow the refrigerant to flow out of the space SP along the arrow AR2. Hereinafter, an opening of the through hole 114, which is open in the space SP and from which the refrigerant is discharged out of the space SP, is referred to as an "opening 115".

The sealing member 120 is a member to seal the lower portion of the housing body 110. The sealing member 120 is formed into substantially a columnar shape and is inserted into the housing body 110 from the lower side thereof. A male screw 121 is formed in an upper portion of a side surface of the sealing member 110. A female screw is formed in an inner surface of the housing body 110. Thus, the sealing member 120 is fixed into the housing body 110 by engaging the male screw 121 with the female screw 111.

A plurality of O-rings 122 are disposed in a space between the outer circumferential surface of the sealing member 120 and the inner surface of the housing body 110. The O-rings 122 prevent the refrigerant from releasing out of the space SP to an outside.

The sealing member 120 corresponds to one of "internal members" that are arranged in a lower portion of the space SP in the refrigerant tank 100.

The filter 130 is a filter to remove foreign substances from the refrigerant circulating the cooling circuit. The filter 130 is disposed on an upper surface of the sealing member 120. The position of the filter 130 is substantially the same as the position of the opening 115. Therefore, the side surface of the filter 130 faces the opening 115.

The filter 130 includes a mesh member 132 and a retainer 131. The mesh member 132 is a fine mesh-patterned member made of resin such as a nylon. The retainer 131 is formed of a plurality of rod-shaped elements to cover the mesh member 132. The filter 130 formed of the mesh member 132 and the retainer 131 has a substantially columnar outer shape.

When the refrigerant circulates in the cooling circuit, the refrigerant in the space SP flows into the mesh member 132 from the upper surface of the filter 130. During passing through the mesh member 132, foreign substances are removed from the refrigerant. Thereafter, the refrigerant flows out of the filter 130 from the side surface thereof, and then flows into the tank 20 through the opening 115 and the through hole 114.

As with the sealing member 120, the filter 130 corresponds to one of the "internal members" that are arranged in the lower portion of the space SP.

The desiccant bag 140 is a bag housing a desiccant DR (see FIG. 3) made of zeolite granules for adsorbing water. The desiccant bag 140 is disposed in the space SP, more specifically, on the upper surface of the filter 130.

The refrigerant may contain water during circulation in the cooling circuit. If the refrigerant containing water circulated in the cooling circuit, the water contained in the refrigerant would be condensed when passing though the expansion valve, which may bring about clogging in the expansion valve. To prevent such clogging, the desiccant bag 140 is used to adsorb water from the refrigerant.

Figure 3A:
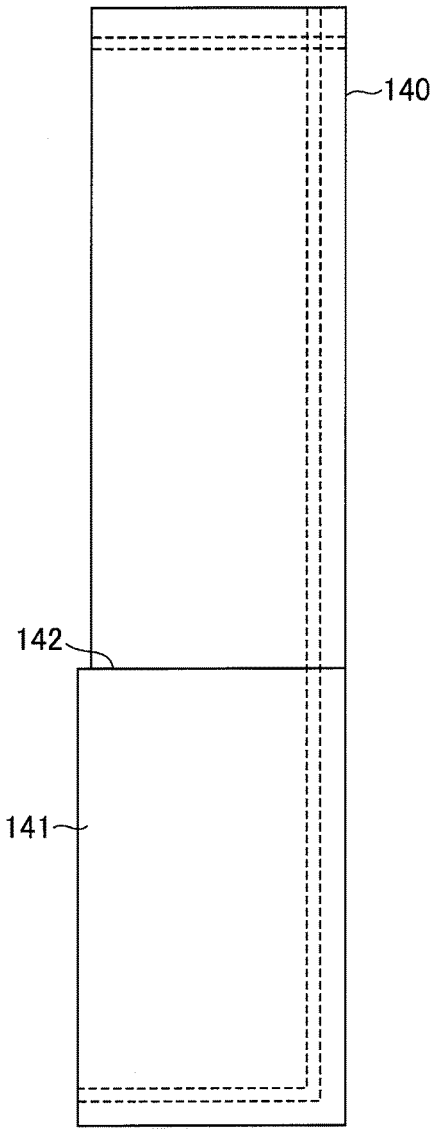
FIGS. 3A and 3B are diagrams illustrating a structure of a desiccant bag.
Figure 3B:
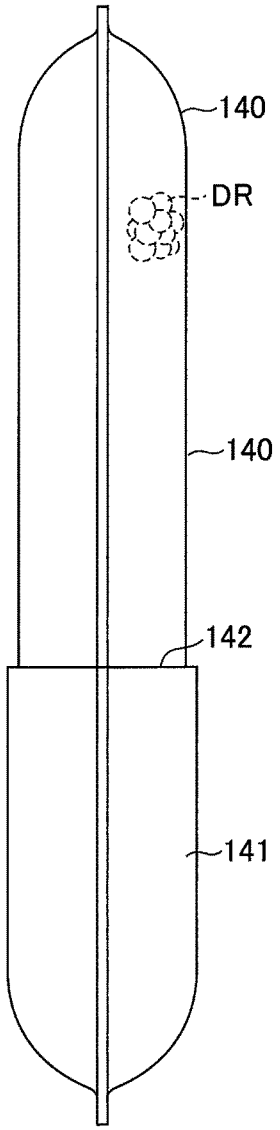

FIG. 3A shows a front side of the desiccant bag 140 and FIG. 3B shows a side of the desiccant bag 140. As shown these figures, the desiccant bag 140 has an elongated shape along the vertical shape. The desiccant bag 140 is disposed in the space SP such that its longitudinal direction extends along the longitudinal direction of the refrigerant tank 100. In FIG. 3B, the desiccant DR housed in the desiccant bag 140 is represented by the broken lines.

The desiccant bag 140 is a bag formed by sewing together breathable and flexible material sheets, more specifically, felted fabrics. When the refrigerant circulates in the cooling circuit, a portion of the refrigerant enters into the desiccant bag 140 and comes to contact with the desiccant DR. Then, water is removed from the refrigerant by being adsorbed by the desiccant DR.

A lower portion of the desiccant bag 140 is covered by a protecting member 141. The protecting member 141 is made of the same material as the desiccant bag 140, i.e., made of felted fabrics. The protecting member 141 is sewed on the desiccant bag 140. Therefore, the lower portion of the desiccant bag 140 has a two-layer structure.

As shown in FIG. 2, the side surface of the desiccant bag 140 faces the opening 113. That is, the lower end of the desiccant bag 140 is lower than the lower end of the opening 113, whereas the upper end of the desiccant bag 140 is higher than the upper end of the opening 113. When the opening 113 is viewed along a flow direction of the refrigerant in the opening 113, the protecting member 141 covers entirely a portion of the desiccant bag 140 that is overlapped with the opening 113.

Figure 8:
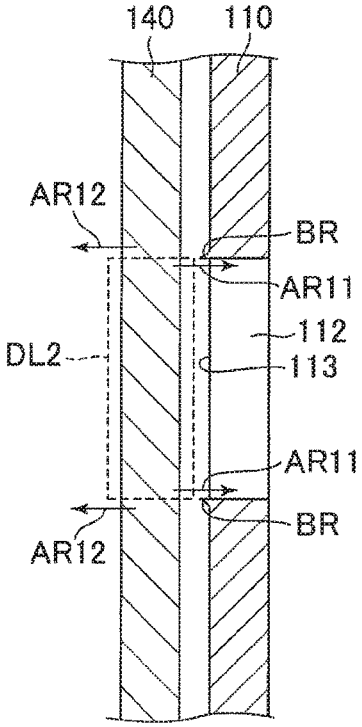
FIG. 8 is a comparative example illustrating a mechanism of applying a shearing force to a desiccant bag.

Next, advantages obtained by providing the protecting member 141 will be described below. FIG. 8 shows a schematic cross-section of a comparative example of the desiccant bag 140 without the protecting member 141.

When refrigerant circulates in the cooling circuit, the desiccant bag 140 receives a force in a direction away from the wall surface of the housing body 110 (the left side in FIG. 8) due to a pressure of the refrigerant flowing into the space SP through the opening 113.

When the circulation of the refrigerant in the cooling circuit stops, a flow of the refrigerant from the space SP toward an outside through the opening 113 (i.e., a reverse flow) may temporarily generate due to a temperature difference in the refrigerant in the cooling circuit. In this case, a force in a direction toward the wall surface of the housing body 110 (the right side in FIG. 8) may be applied to the desiccant bag 140 due to the refrigerant flowing out of the opening 113. As a result, the desiccant bag 140 is pressed against an edge portion of the housing body 110 by the force and maintains the contact status with the edge portion.

During this state, a force in a direction indicated by the arrow AR11 is applied to a portion of the desiccant bag 140 facing the opening 113 (the portion surrounded by the broken line DL2 in FIG. 8). On the other hand, a force in a direction indicated by the arrow AR12 (i.e., the opposite direction of the arrow AR11) is applied to portions of the desiccant bag 140 facing portions of the housing body 110 outside of the opening 113. As a result, shearing forces generate around areas of the desiccant bag 140 where the broken line DL2 passes through.

When the circulation of the refrigerant in the cooling circuit repeatedly starts and stops, the desiccant bag 140 is repeatedly brought into contact with the edge of the opening 113. Therefore, the shearing forces are also repeatedly applied to the desiccant bag 140. As a result, the desiccant bag 140 may be damaged due to the shearing forces.

Especially, burrs BR are likely to be produced during manufacturing process around the edge of the opening 110 in the housing body 110. Such burrs BR usually protrude from the edge of the opening 113 into the space SR. If the desiccant bag 140 is presses against the edge of the opening 113, the desiccant bag 140 is also likely to be damaged by the burrs BR. In this way, the areas of the desiccant bag 140 where the broken line DL2 passes through are more likely to be damaged when the desiccant bag 140 comes into contact with the edge of the opening 113.

Figure 4:
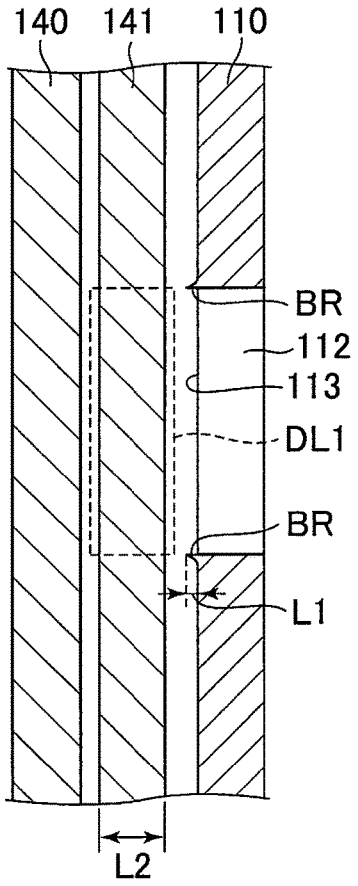
FIG. 4 is a cross-section of a protecting member for the desiccant bag.

In contrast, the portion of the desiccant bag 140 facing the opening 113 is entirely covered by the protecting member 141 according to the present disclosure, as shown in FIG. 4. In other words, the position of the upper edge 142 of the protecting member 141 (see FIG. 3) is higher than the upper edge of the opening 113. Thus, even if a revers flow of the refrigerant through the opening 113 generates and a force in a direction toward the wall surface of the housing body 110 is applied to the desiccant bag 140, the desiccant bag 140 can be prevented from directly coming into contact with the edge of the opening 113.

The portion of the protecting member 141 facing the opening 113 (i.e., the portion surrounded by the broken line DL1 in FIG. 4) receives a force in a direction toward the wall surface of the housing body 110 due to the refrigerant flowing out of the opening 113. As a result, shearing forces as described in FIG. 8 are applied around areas of the protecting member 141 where the broken line DL1 passes through. In the present embodiment, most of the shearing forces are applied to the protecting member 141, and the desiccant bag 140 receives almost no shearing force.

Therefore, when the circulation of the refrigerant in the cooling circuit repeatedly starts and stops, although the protecting member 141 may be damaged by the shearing forces, damages to the desiccant bag 140 can be prevented. Even if the portion of the protecting member 141 surrounded by the broken line DL1 is damaged and lost, other portions of the protecting member 141 remain. Therefore, the effect by the protecting member 141 to prevent the desiccant bag 140 from coming into contact with the edge of the opening 113 maintains. As a result, it is possible to prevent damages to the desiccant bag 140 for a longer time as compared to a situation where a desiccant bag has two times of a thickness but there is no protecting member.

As described above, the protecting member 141 prevents the descant bag 140 from coming into contact with the edge of the opening 113 in the housing body 110. The protecting member 141 corresponds to a "contact preventing member."

As shown in FIG. 4, the thickness L2 of the protecting member 141 is greater than a protruding amount L1 of the burrs BR toward the space SP. Accordingly, even if the protecting member 141 is pressed against the edge of the opening 113, the burrs BR are prevented from piercing the protecting member 141. Therefore, it is possible to suppress damages to the protecting member 141 for a long period.

The region of the desiccant bag 140 covered by the protecting member 141 may be narrowed or widened as compared to the present embodiment. For example, the entire region of the desiccant bag 140 may be covered by the protecting member 141. In any event, at least the portion of the desiccant bag 140 overlapped with the opening 113 is entirely covered by the protecting member 141.

Next, a second embodiment will be described with reference to FIG. 5.

In the second embodiment, the protecting member 141 to cover a portion of the desiccant bag 140 is eliminated. In addition, an extending portion 131A is formed in the retainer 131 of the filter 130. The refrigerant tank 100 of the present embodiment is structurally different from the first embodiment in these two points.

The extending portion 131A is formed to extend upward from the upper surface of the retainer 131. In FIG. 5, the broken line DL3 indicates the upper end position of the opening 113. The extending portion 131A extends to exceed the upper end position of the opening 113.

As with the first embodiment, the desiccant bag 140 is disposed on the upper surface of the filter 130. In other words, the desiccant bag 140 is disposed on the extending portion 131A. Therefore, the side surface of the desiccant bag 140 does not face the opening 113. In other words, the lower end of the desiccant bag 140 is higher than the upper end position of the opening 113 (i.e., the broken line DL3).

According to this structure, even if a reverse flow of the refrigerant generates through the opening 113, the desiccant bag 140 is prevented from coming into contact with the edge of the opening 113. Therefore, shearing forces as described in FIG. 8 do not generate against the desiccant bag 140, and thus damages to the desiccant bag 140 can be prevented.

In the refrigerant tank 100 of the present embodiment, the extending portion 131A retains the desiccant bag 140 at a particular position in the space SP. Therefore, the desiccant bag 140 is prevented from coming into contact with the edge of the opening 113. This "particular position" is a position at which the desiccant bag 140 is not overlapped with the opening 113 when viewed along a flow direction of the refrigerant in the opening 113.

The extending portion 131A corresponds to a "contact preventing member" of the present disclosure. The contact preventing member is a portion of an "internal member", more specifically, a portion of the filter 130, that is disposed at a lower side of the space SP and extends upward of the space SP. Alternatively, the contact preventing portion may be a portion of the sealing member 120, as the internal member, which extends upward of the space SP. In this case, the desiccant bag 140 is disposed directly on the sealing member 120.

Next, a third embodiment will be described with reference to FIG. 6.

In the third embodiment, the protecting member 141 to cover a portion of the desiccant bag 140 is eliminated. In addition, a spacer 200 is disposed on the retainer 131 of the filter 130. The refrigerant tank 100 of the present embodiment is structurally different from the first embodiment in these two points.

Figure 7:
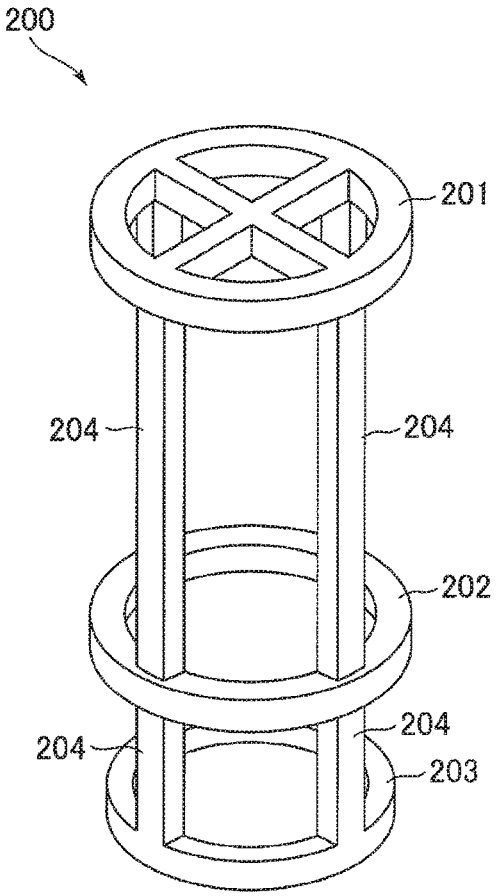
FIG. 7 is a perspective view of a spacer shown in FIG. 6.

The spacer 200 is disposed on an "internal member" that is disposed in a lower side of the space SP, more specifically, on the filter 130. As shown in FIG. 7, the spacer 200 includes an upper portion 201, a middle portion 202, and a lower portion 203, each of which has a ring shape, and the upper portion 201, the middle portion 202, and the lower portion 203 are connected to each other through three members 240 each extending a vertical direction. The spacer 200 is integrally made from resin material into one component.

Figure 5:
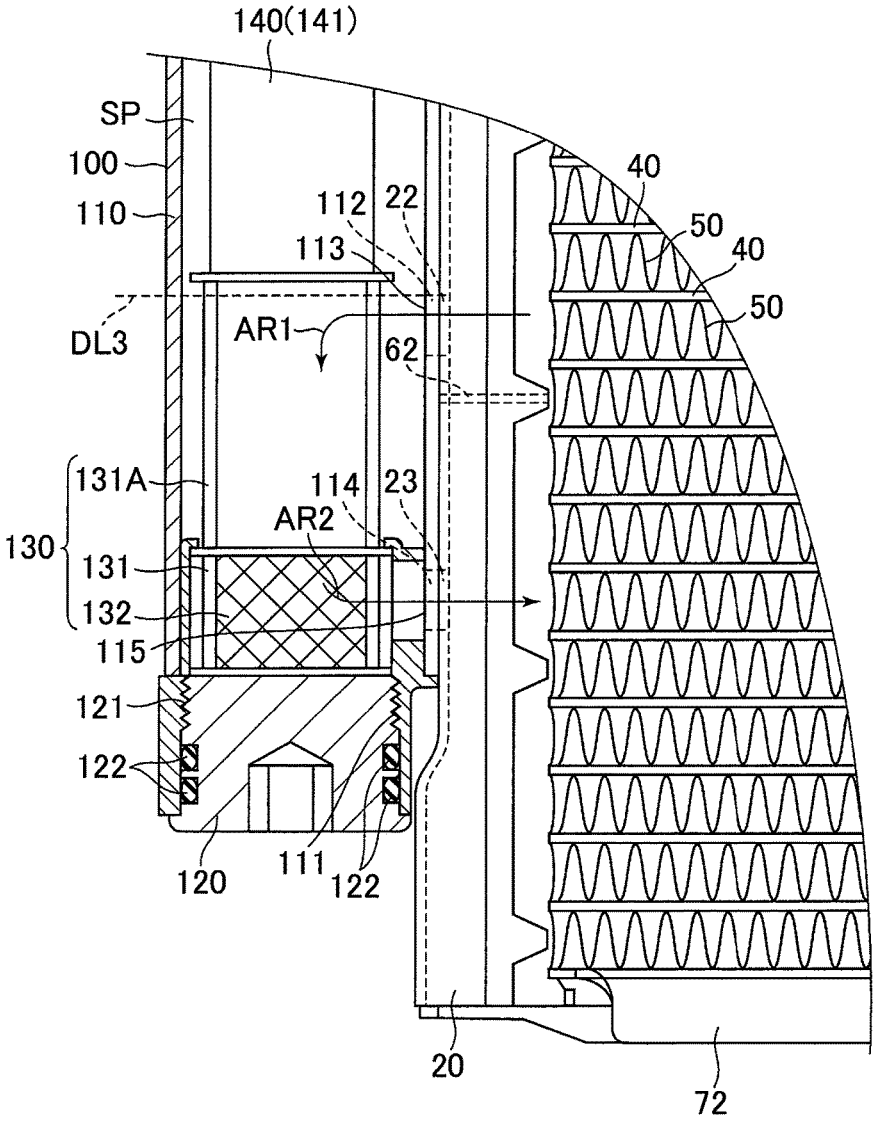
FIG. 5 is a diagram illustrating a refrigerant tank according to a second embodiment.
Figure 6:
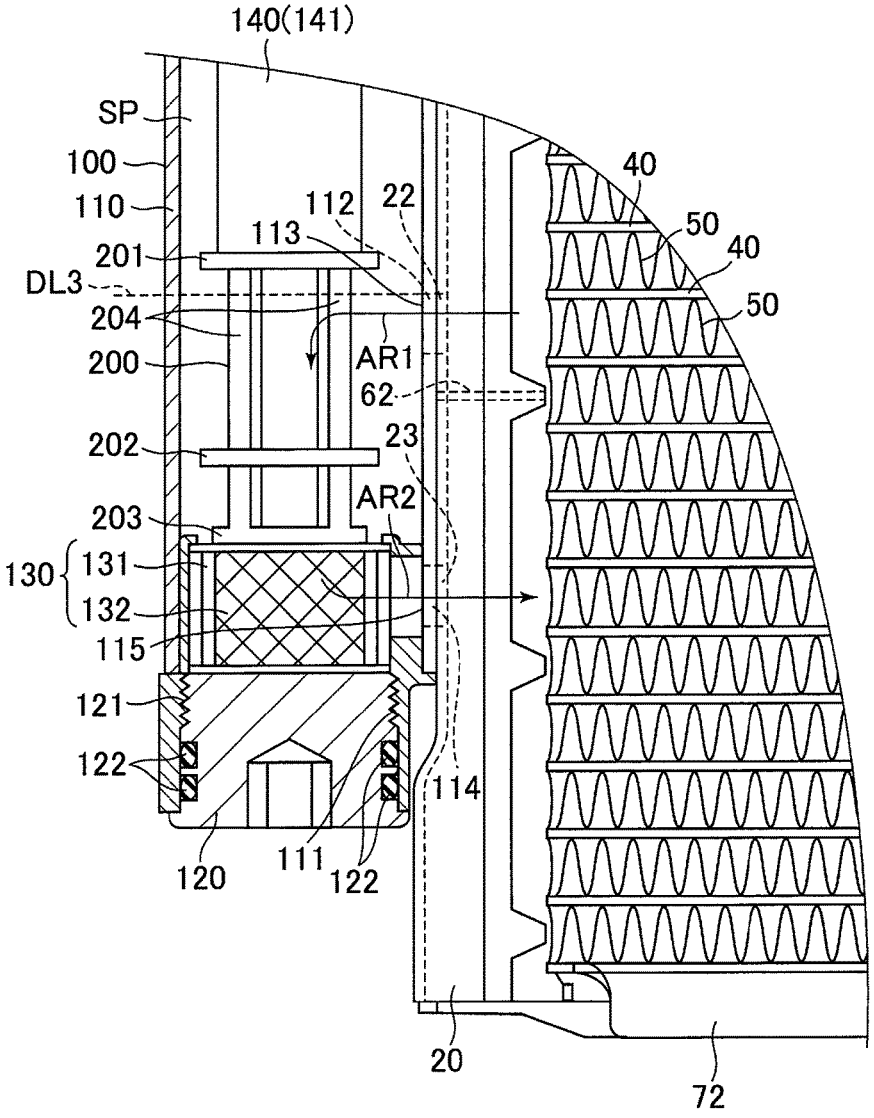
FIG. 6 is a diagram illustrating a refrigerant tank according to a third embodiment.

As with FIG. 5, FIG. 6 shows the broken line DL3 indicating the upper edge position of the opening 113. The upper end position of the spacer 200 is higher than the upper edge position of the opening 113.

In this embodiment, the desiccant bag 140 is disposed on the upper surface of the spacer 200, i.e. the upper surface of the upper portion 201. Therefore, the side surface of the desiccant bag 140 does not face the opening 113. That is, the lower end of the desiccant bag 140 is higher than the upper edge position (i.e., the broken line DL3).

According to the structure, even if a reverse flow of the refrigerant generates through the opening 113, the desiccant bag 140 is prevented from coming into contact with the edge of the opening 113. Therefore, shearing forces as described in FIG. 8 do not generate against the desiccant bag 140, and thus damages to the desiccant bag 140 can be prevented.

In the refrigerant tank 100 of the present embodiment, the spacer 200 retains the desiccant bag 140 at a particular position in the space SP. Therefore, the desiccant bag 140 is prevented from coming into contact with the edge of the opening 113. This "particular position" is a position at which the desiccant bag 140 is not overlapped with the opening 113 when viewed along a flow direction of the refrigerant in the opening 113.

The spacer 200 corresponds to a "contact preventing member" of the present disclosure. The contact preventing member is disposed on an "internal member", more specifically, on the filter 130, that is disposed in a lower side of the space SP. It should be noted that the shape of the space 200 may not be necessarily limited to the shape shown in FIG. 7, and the spacer 200 may have other shapes.

In the above description, the sub-cooling portion of the condenser 10 is disposed at a lower side of the heat exchange core. However, the position of the sub-cooling portion is not limited to such a position. For example, the sub-cooling portion may be disposed in an upper side of the heat exchanger core.

As with a condenser for an air-conditioning unit described in JP 2008-529877 A, refrigerant passing through the heat exchanger core flows into the refrigerant tank (a control tank) from a lower side of the refrigerant tank, and then flows out of the refrigerant tank from an upper side of the refrigerant tank toward the sub-cooling portion. In a case where the desiccant bag 140 is disposed in such a refrigerant tank, the above-described structures may be applied.

In the above-described embodiments, the refrigerant tank 100 is configured as a modulator tank integrally formed with the condenser 10. Alternatively, the refrigerant tank 100 may be configured as a receiver tank that is disposed downstream of the condenser. That is, the refrigerant tank 100 may not be integrally formed with the condenser but be separately formed as a single component.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. Example embodiments are provided so that this disclosure will be thorough, and will convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed. As used herein, the term "and/or" includes any and all combinations of one or more of the associated listed items.

What is claimed is:

1. A refrigerant tank for storing a refrigerant, the refrigerant tank comprising:

a housing body that defines therein a space for storing the refrigerant; and a desiccant bag that houses a desiccant therein and is disposed inside the space of the housing body, wherein the housing body includes a side surface defining an opening through which the refrigerant passes, and the refrigerant tank further comprises a contact preventing member that prevents the desiccant back from coming into contact with an edge of the opening.

2. The refrigerant tank according to claim 1, wherein the contact preventing member is a protecting member that covers a portion of the desiccant bag.

3. The refrigerant tank according to claim 2, wherein the protecting member entirely covers at least a portion of the desiccant bag that is overlapped with the opening when viewed along a flow direction of the refrigerant at the opening.

4. The refrigerant tank according to claim 3, wherein the protecting member is made of the same material as the desiccant bag.

5. The refrigerant tank according to claim 3, wherein the protecting member is configured to have a thickness that is greater than a protruding amount of a burr, assuming that the burr is produced at the edge of the opening to protrude from the edge toward the space.

6. The refrigerant tank according to claim 1, wherein the contact preventing member is configured to prevent the desiccant bag from coming into contact with the edge of the opening by retaining the desiccant bag at a particular position.

7. The refrigerant tank according to claim 6, wherein the particular position is a position at which the desiccant bag is not overlapped with the opening when viewed along a flow direction of the refrigerant in the opening.

8. The refrigerant tank according to claim 7, wherein the contact preventing member is a portion of an internal member that is disposed in a lower side of the space and extends upward of the space.

9. The refrigerant tank according to claim 8, wherein the internal member is a filter to remove a foreign substance from the refrigerant.

10. The refrigerant tank according to claim 7, wherein the contact preventing member is a spacer that is disposed on an internal member that is disposed in a lower side of the space.

* * * * *